US006328662B1

(12) United States Patent
Huang

(10) Patent No.: US 6,328,662 B1
(45) Date of Patent: Dec. 11, 2001

(54) FOUR-IN-ONE GOLF PUTTER

(76) Inventor: Chun-Yao Huang, No. 7, Alley 46, Lane 329, Ya-Tan Rd., Ta-Ya Hsiang, Taichung Hsien (TW)

( * ) Notice: Subject to any disclaimer, the term of this patent is extended or adjusted under 35 U.S.C. 154(b) by 0 days.

(21) Appl. No.: 09/512,464

(22) Filed: Feb. 24, 2000

(51) Int. Cl.[7] ..... A63B 53/04

(52) U.S. Cl. ..... 473/334; 473/338; 473/340; 473/341

(58) Field of Search ..... 473/324, 340, 473/341, 349, 313, 314, 251, 238, 256, 334, 335, 338, 344, 288

(56) References Cited

U.S. PATENT DOCUMENTS 2,332,342 * 10/1943 Reach .
3,042,405 * 7/1962 Solheim .
3,516,674 * 6/1970 Scarborough .
4,121,832 * 10/1978 Ebbing .
4,979,744 * 12/1990 Alcala .
5,078,398 * 1/1992 Reed .
5,308,067 * 5/1994 Cook .
5,938,543 * 8/1999 McGeeney .
6,086,484 * 7/2000 Uebelhor .

* cited by examiner

*Primary Examiner*—Sebastiano Passaniti
(74) *Attorney, Agent, or Firm*—Dougherty & Troxell

(57) ABSTRACT

A four-in-one golf putter mainly comprises a body, two wing parts, and an insertion piece, which are made of different materials in different specific gravities, for organizing various combinations with different positions of center of gravity in order to meet requirements of different golfers.

3 Claims, 12 Drawing Sheets

FOUR-IN-ONE GOLF PUTTER

BACKGROUND OF THE INVENTION

A complacent golf putter is something to a golfer just like a good brush is to a painter. The common point is that both require delicate skills, which can be accumulated and upgraded only by constant practice.

As the green is where the golfers fight it out, in addition to skill and experience, a complacent putter is also considered a key weapon for winning a game. However, as the center of gravity of an existing golf putter is usually unadjustable and located at its center position, a slight striking deflection will cause a miss of the so-called "sweet spot" effectively.

Various patented structures of golf putter are briefly described with annexed diagrams as below:

1. According to the disclosed patent No. 83208275 in Taiwan dated Mar. 1, 1996 (shown in FIG. 1), a putter head 1 is combined with a neck 10, wherein the putter head 1 is provided with a plurality of tapped holes 11 selectable for fixedly jointing the putter head 1 to the neck 10 and a golf shaft 12, and for compensating offset of a center of gravity A (shown in FIG. 2). However, in the small enclave of the putter head 1, only a few tapped holes 11 can be made available for adjusting the center of gravity A. It can hardly meet different requirements of the users.

2. According to another disclosed patent No. 83216776 in Taiwan dated Jul. 1, 1996 (shown in FIG. 3), a putter head 2 and a neck 20 are screw-jointed, then a shaft 21 is inserted in the neck 20 to form a golf club. In this structure, the center of gravity A is fixed because there is only one screw-joint position available in spite of the rotatable neck 20.

3. According to a further disclosed patent No. 80210365 in Taiwan dated Apr. 21, 1997 (shown in FIG. 5), a neck 30 is inserted in a putter head 3 then jointed with a shaft 31, wherein the neck 30 is curved in a designated angle with a specified weight, hence, the center of gravity is deflected upwards from the ball center (shown in FIG. 6) to affect striking accuracy.

In view of the above-described imperfections, after years of constant effort in research, the inventor of this invention has consequently developed and proposed an improved framework pertaining to the subject matter.

SUMMARY OF THE INVENTION

This invention relates to a four-in-one golf putter comprising a body, two wing parts, and an insertion piece, made of a material respectively with specific gravity different from each other, which may be associated in different combinations and adjusted to create center of gravity in different positions. For more detailed information regarding this invention together with further advantages or features thereof, at least an example of a preferred embodiment will be elucidated below with reference to the annexed drawings.

BRIEF DESCRIPTION OF THE DRAWINGS

The related drawings in connection with the detailed description of this invention to be made later are listed and described briefly as follows in which.

DETAILED DESCRIPTION OF THE PREFERRED EMBODIMENT

Figure 1:
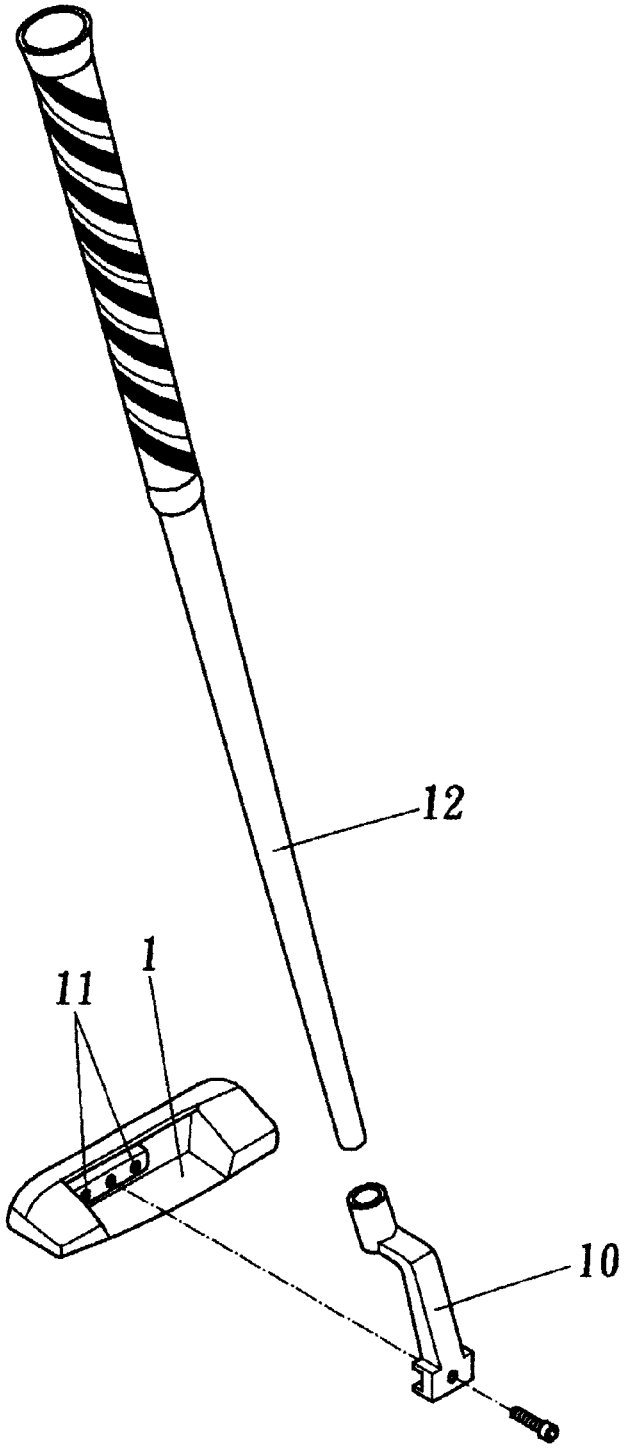
FIG. 1 PRIOR ART
FIG. 1 is a three-dimensional exploded view of a conventional golf putter (1)
Figure 2:
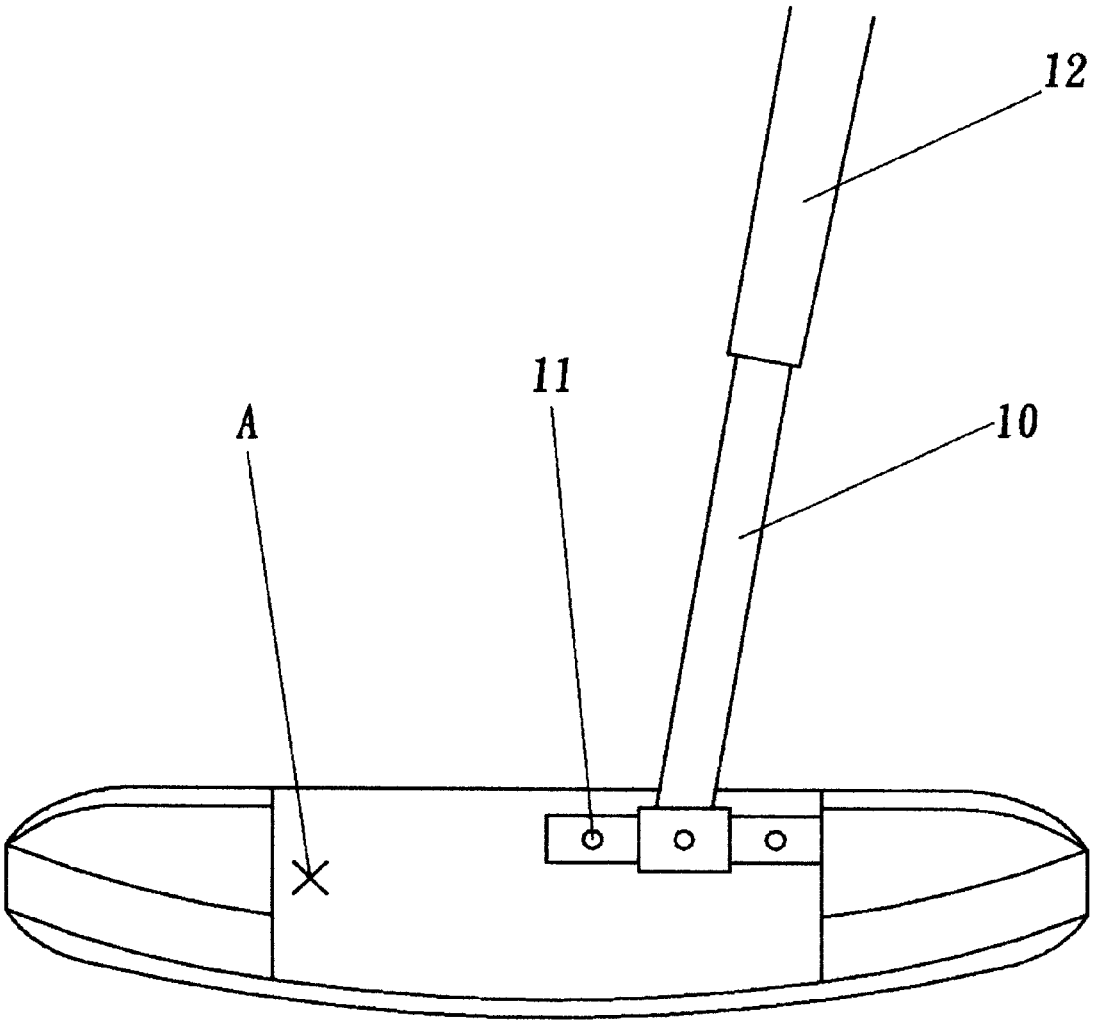
FIG. 2 PRIOR ART
FIG. 2 is a schematic view showing center of gravity of the conventional golf putter (1)
Figure 3:
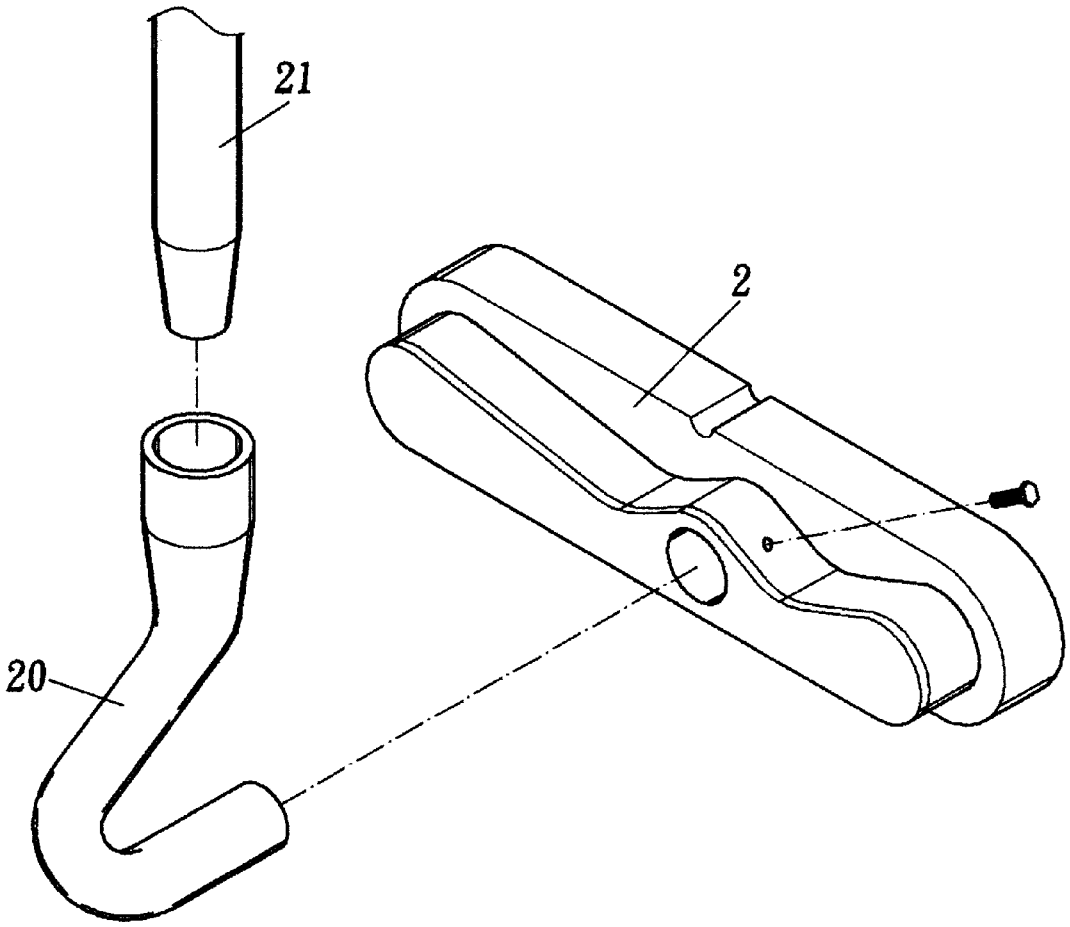
FIG. 3 PRIOR ART
FIG. 3 is a three-dimensional exploded view of a conventional golf putter (2)
Figure 4:
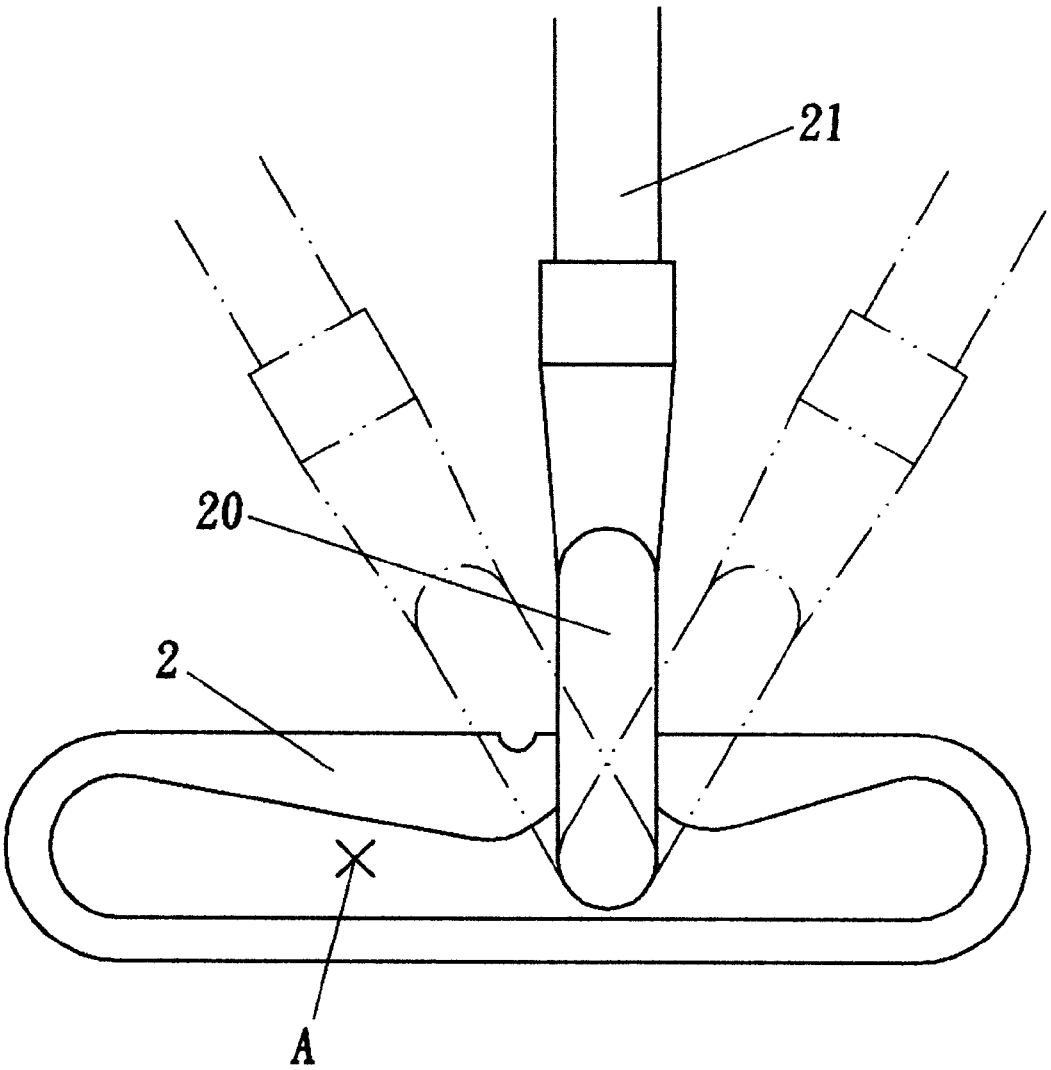
FIG. 4 PRIOR ART
FIG. 4 is a schematic view showing center of gravity of the conventional golf putter (2)
Figure 5:
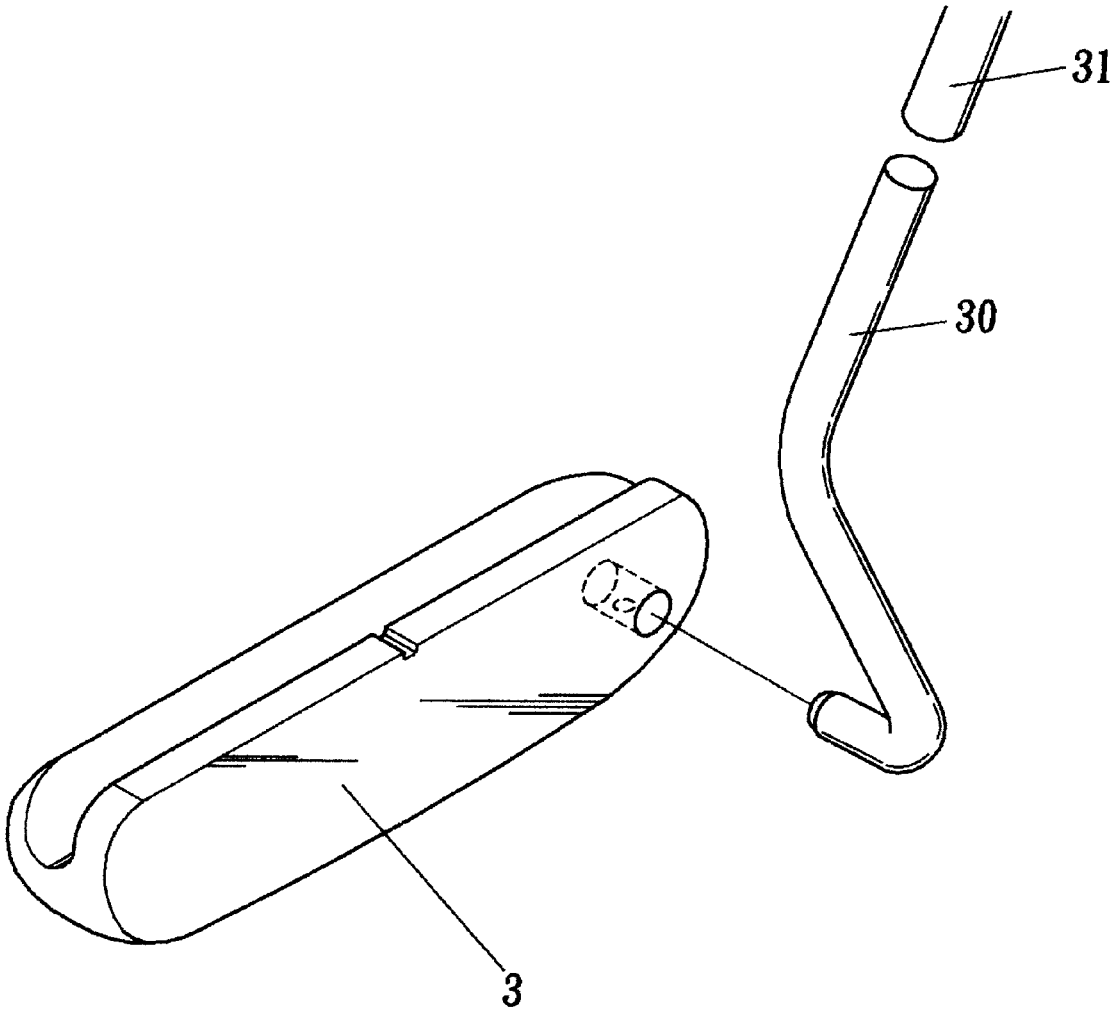
FIG. 5 PRIOR ART
FIG. 5 is a three-dimensional exploded view of a conventional golf putter (3)
Figure 6:
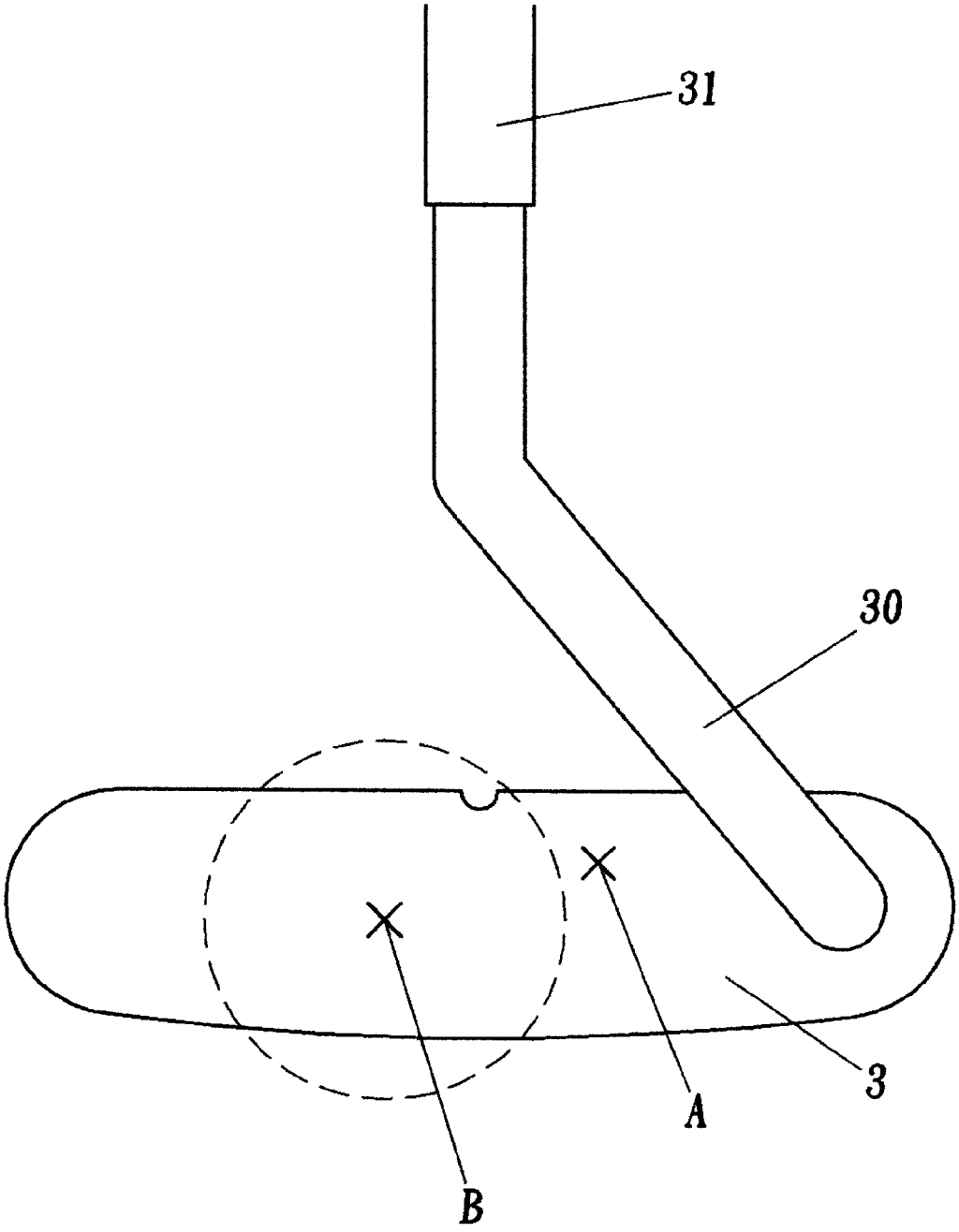
FIG. 6 PRIOR ART
FIG. 6 is a schematic view showing center of gravity of the conventional golf putter (3)
Figure 7:
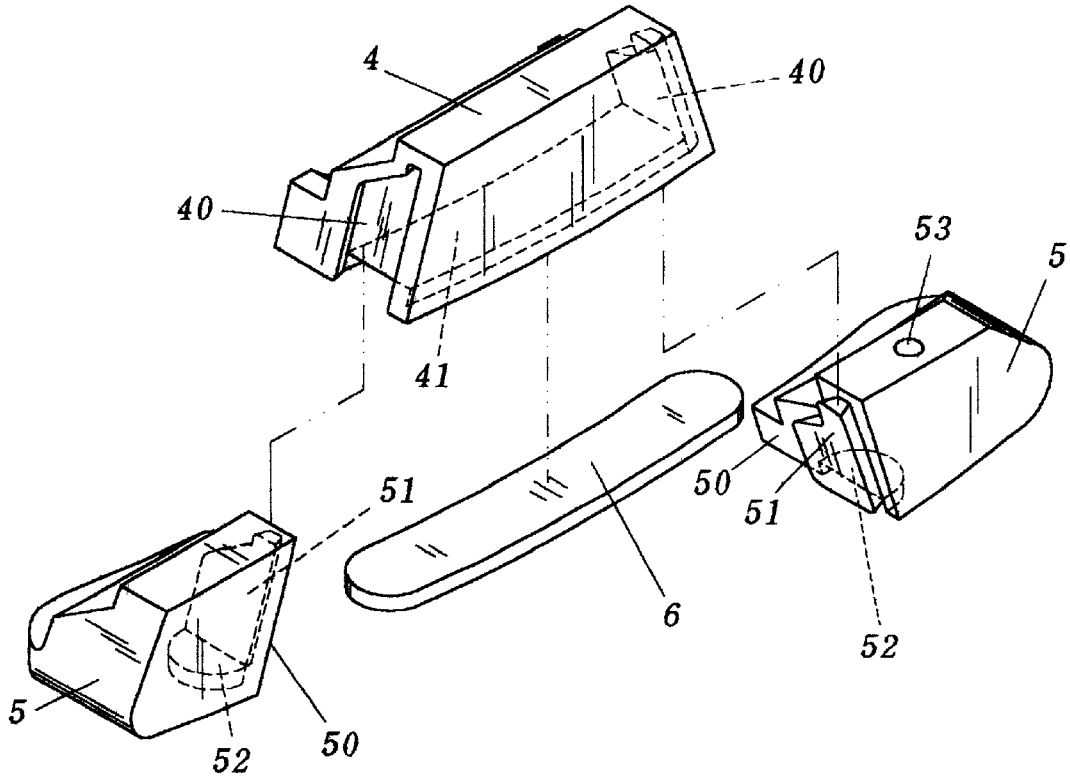
FIG. 7 is a three-dimensional exploded view of a golf putter of this invention.

As shown in FIG. 7, a golf putter of this invention mainly comprises a trapezoid body 4, two wing parts 5, and an insertion piece 6. The body 4 is made of a material in a relatively smaller specific gravity, wherein a dovetail groove 40 is formed in two lateral faces respectively, which communicate with an insertion channel 41 disposed in the bottom face of the body 4. The wing parts 5 are insertion-jointed with those lateral faces of the body 4, wherein a slope 50 is formed at each of two opposite inner faces of the wing parts 5; a dovetail protrusion 51 matching with the dovetail groove 40 is arranged on each slope 50; an insertion channel 52 is formed in the bottom end of each wing part 5 at a position corresponding to the insertion channel 41; and on a top end of one wing part 5, a plugging hole 53 is arranged for reception of a club B. The insertion piece 6 is to be insertion-jointed with the bottom face of the body 4 and the wing parts 5, wherein the insertion piece 6 is made of a material in specific gravity different from that of the body 4 and the wing parts 5.

Figure 8:
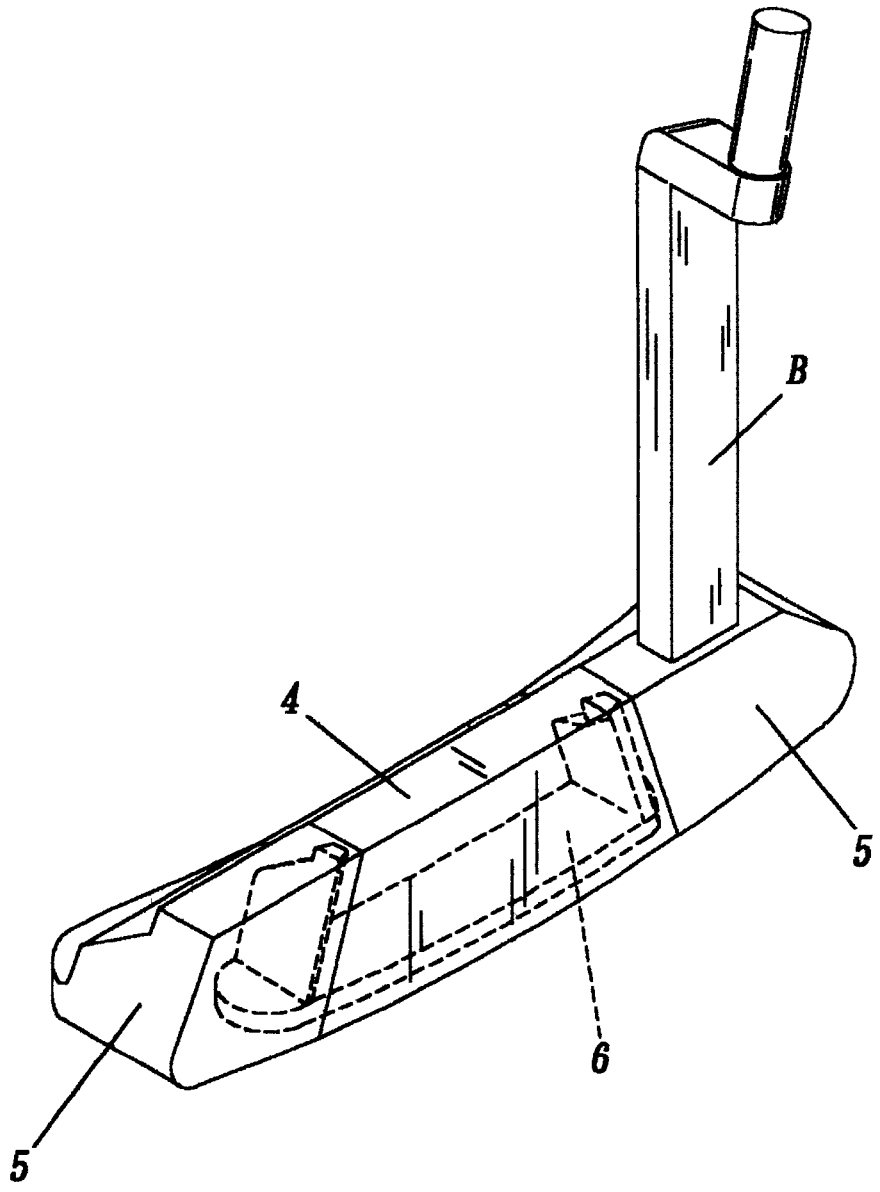
FIG. 8 is a three-dimensional assembled view of this invention.
Figure 9:
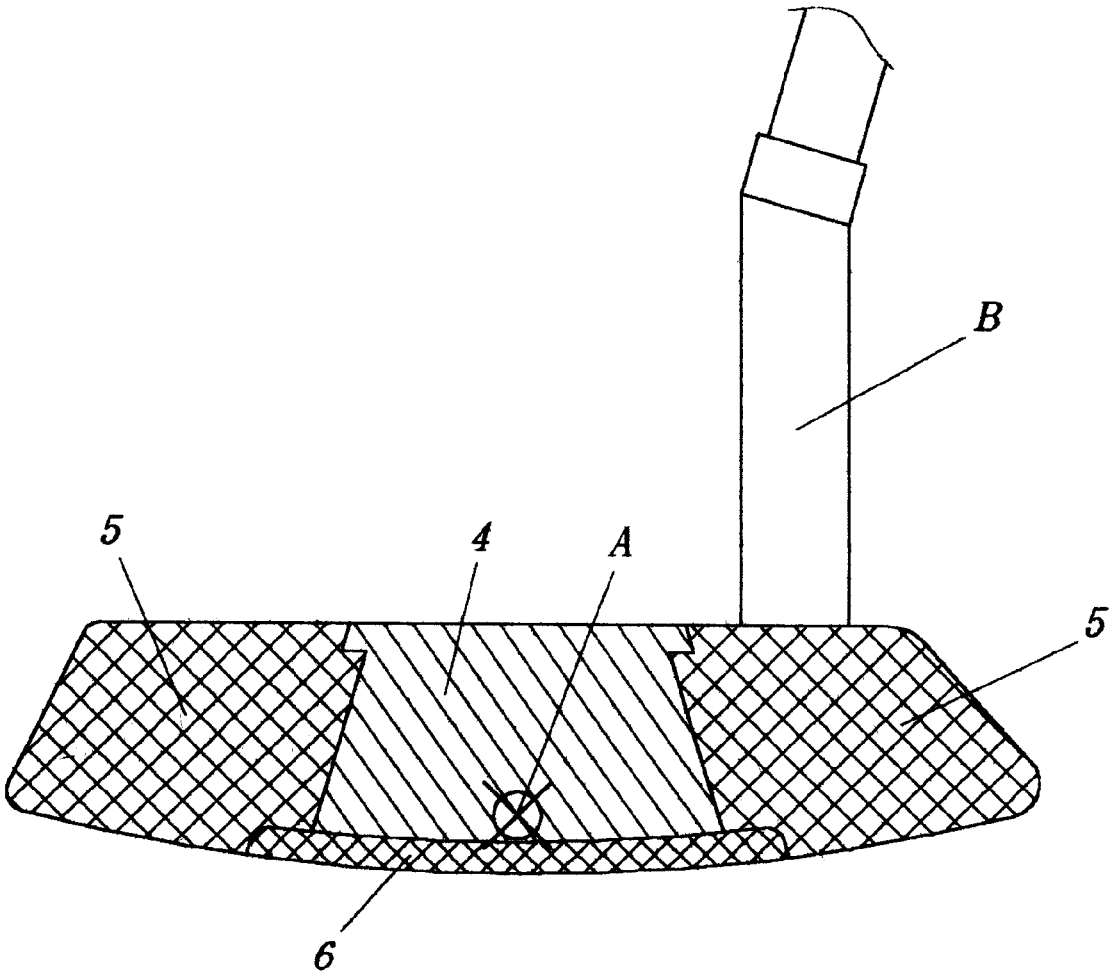
FIG. 9 is a schematic view showing a center of gravity of this invention.
Figure 10:
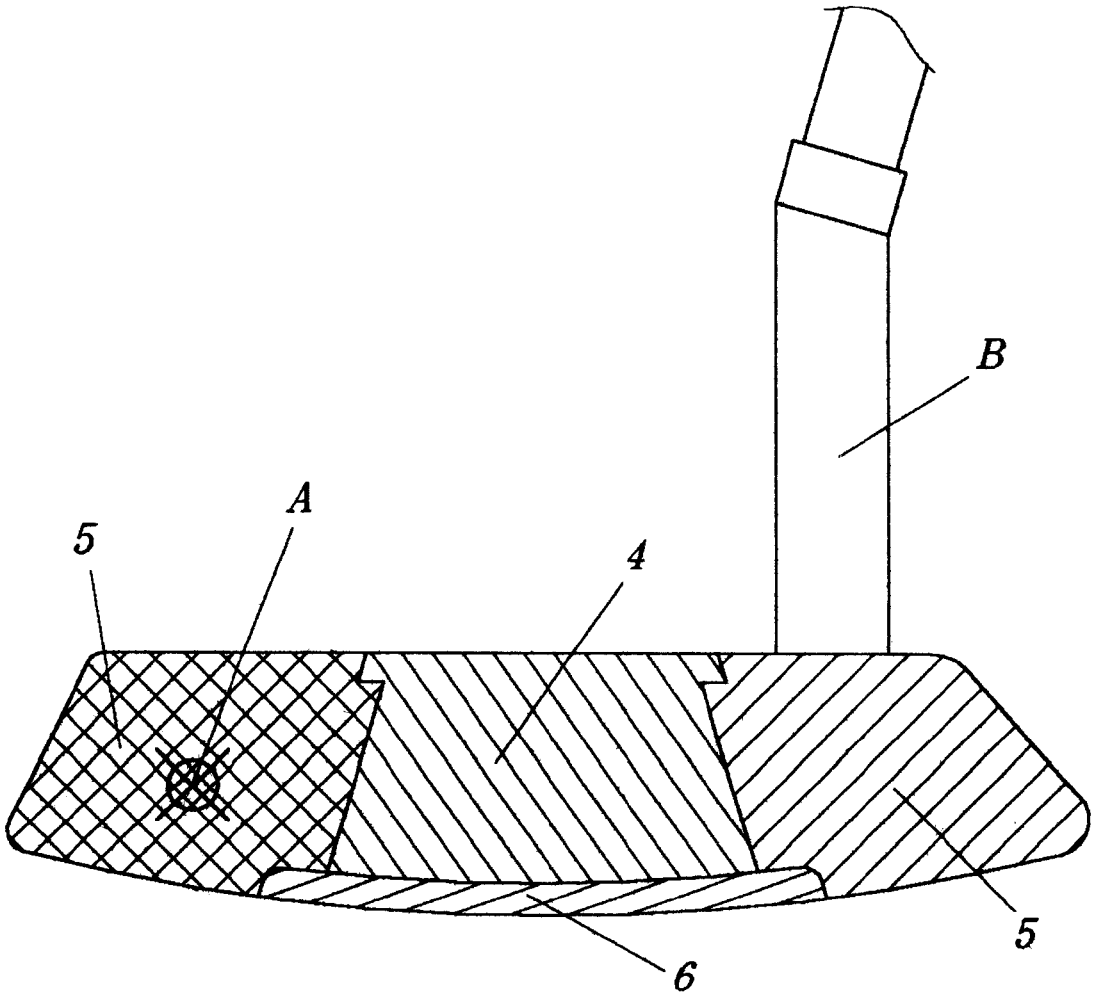
FIG. 10 is a schematic view showing horizontal offset of the center of gravity of this invention.
Figure 11:
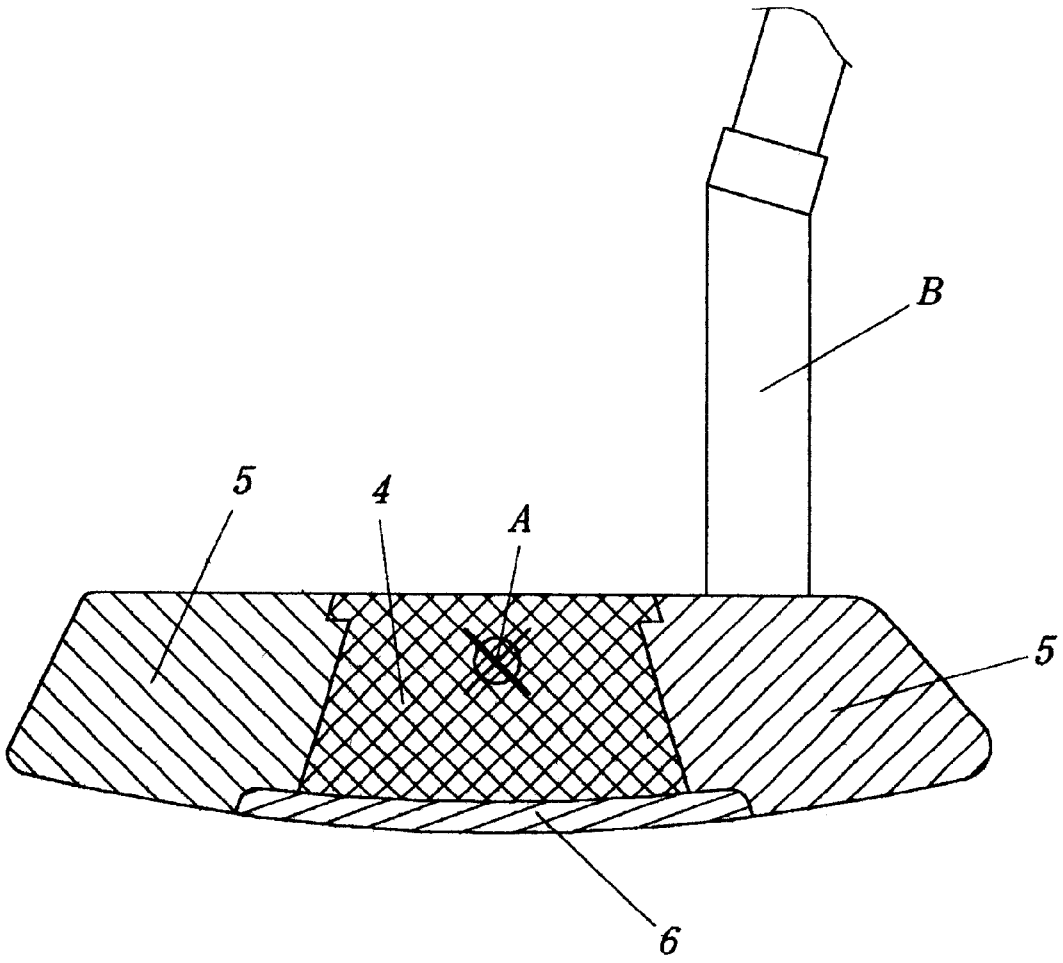
FIG. 11 is a schematic view showing vertical offset of the center of gravity of this invention.
Figure 12:
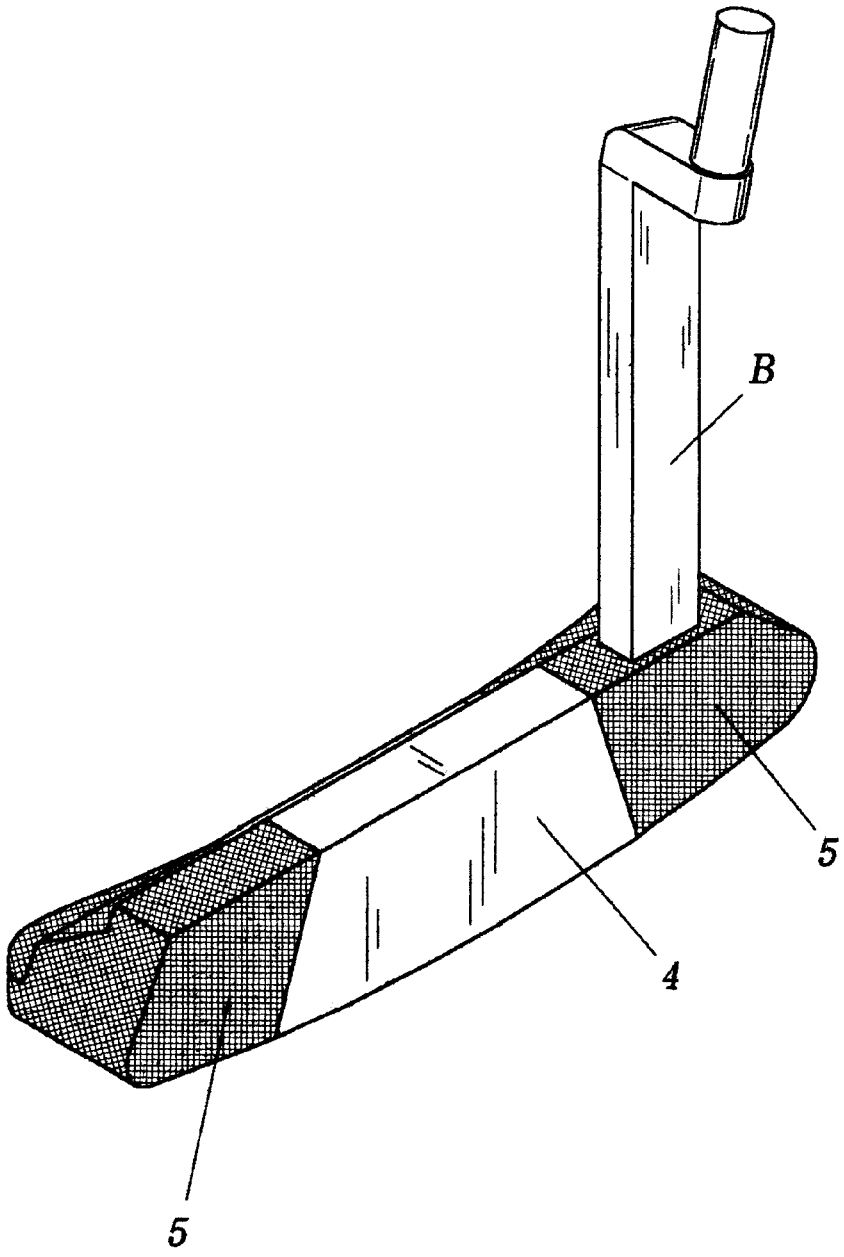
FIG. 12 is a schematic view showing combination in different colors of this invention.

When assembling, as shown in FIG. 8, the dovetail protrusions 51 of the wing parts 5 are firstly inserted in the dovetail grooves 40 of the body 4 respectively, then the insertion piece 6 is inserted in the insertion channel 41, 52 to firmly solidify the body 4 and the wing parts 5, and finally, the club B is plugged in the plugging hole 53 to complete a golf putter of this invention. In this construction, as the specific gravity of the wing part 5 at both ends is larger than that of the body 4, the weight is distributed in unison at both ends. A material with relatively larger specific gravity may be selected for the insertion piece 6 to lower down the center of gravity A (shown in FIG. 9). Moreover, in case changing the position of the center of gravity is desired, different materials in different specific gravities may be used respectively for the body 4, the wing parts 5, and the insertion piece 6 for selective combinations in order to create horizontal or vertical offset of the center of gravity (shown in FIG. 10 and FIG. 11) to meet various requirements of different golfers.

Further, because a four-in-one assembly manner is adopted in this invention, including a body 4, two wing parts 5, and an insertion piece 6, it is possible to gather and assemble the constituents in different colors to present diversified configurations and beautification for raising its additional value.

According to the abovesaid, the merits of this invention may be summarized as follows:

1. By four-in-one assembly manner, it is possible to change the material used in the body, the wing parts, and the insertion piece for adjusting the center of gravity to meet different requirements.

2. Insertion of the dovetail protrusions in the corresponding dovetail grooves instead of the usual screw-jointed manner is more advantageous in keeping combination without loosening or deflection to thereby upgrade striking accuracy.

3. The body, the wing parts, and the insertion piece may be combined in different colors to promote beautification and additional value.

In the above described, at least one preferred embodiment has been elucidated with reference to drawings annexed, it is apparent that numerous variations or modifications may be made without departing from the true spirit and scope thereof, as set forth in the claims below.

What is claimed is:

1. A four-in-one golf putter, comprising:

a body made of a light material comprising two lateral faces, a bottom face, a dovetail groove formed in each of said two lateral faces and an insertion channel formed in said bottom face;

two wing parts made of a material heavier than the material of said body being separately insertion-jointed to said two lateral faces of said body, wherein a dovetail protrusion is formed on each of two opposite inner faces of said wing parts, and an undercut insertion channel is made at a bottom end of each of said wing parts; and an insertion piece inserted in an insertion channel of said body and each of said insertion channels of each said wing part and being made of a material of a specific gravity different from that of said body and said wing parts;

whereby said body, said wing parts, and said insertion piece are each made from a material with a different specific gravity one from the other and assembled to allow the location of the center of gravity to be adjusted by an individual golfer.

2. The four-in-one golf putter of claim 1, wherein said body is made in the shape of a trapezoid; a slope is formed in two opposite inner faces of said wing parts respectively; and a plugging hole is disposed in a top end of one of said wing parts.

3. The four-in-one golf putter of claim 1, wherein different colors may be adopted for said body, said wing parts and said insertion piece.

* * * * *